US006389635B1

(12) United States Patent
Petner et al.

(10) Patent No.: US 6,389,635 B1
(45) Date of Patent: May 21, 2002

(54) BUTTERFLY MOP BASE PLATE ASSEMBLY

(75) Inventors: Robert E. Petner, Burlington, NJ (US); Jace A. Weaver, Gilbertsville, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 09/580,355

(22) Filed: May 25, 2000

(51) Int. Cl.[7] ..... A47L 13/146
(52) U.S. Cl. ..... 15/119.2
(58) Field of Search ..... 15/116.2, 119.2

(56) References Cited

U.S. PATENT DOCUMENTS

| | | | | | |
|---|---|---|---|---|---|
| 2,643,407 | A | | 6/1953 | Vosbikian et al. | 15/119.2 |
| 2,730,742 | A | * | 1/1956 | Zottola | 15/116.2 |
| 2,730,743 | A | * | 1/1956 | Zottola | 15/116.2 |
| 2,834,035 | A | | 5/1958 | Vosbikian et al. | 15/119.2 |
| 2,858,557 | A | * | 11/1958 | Zottola | 15/119.2 |
| 2,864,107 | A | * | 12/1958 | Greenleaf | 15/119.2 |
| 2,883,689 | A | * | 4/1959 | Vosbikian et al. | 15/119.2 |
| 2,967,317 | A | * | 1/1961 | Richards | 15/119.2 |
| 3,147,502 | A | * | 9/1964 | Richards | 15/119.2 X |
| 4,312,092 | A | * | 1/1982 | Lundgren | 15/119.2 |
| 4,468,830 | A | * | 9/1984 | Batchelor | 15/119.2 |
| 5,483,720 | A | | 1/1996 | DeCoopman et al. | 15/119.2 |
| D420,775 | S | | 2/2000 | Petner | D32/51 |
| RE36,635 | E | | 4/2000 | Vosbikian | 15/119.2 |

FOREIGN PATENT DOCUMENTS

| | | | | |
|---|---|---|---|---|
| CA | 463790 | * | 3/1950 | 15/119.2 |
| FR | 2302710 | * | 10/1976 | 15/119.2 |

* cited by examiner

*Primary Examiner*—Mark Spisich
(74) *Attorney, Agent, or Firm*—Stuart M. Goldstein

(57) ABSTRACT

A base plate assembly for a butterfly sponge mop consists of two side shell pieces, each with two outwardly extending axle members. The axle members are directly connected to the front and rear walls of the mop's center sponge member support. No additional hardware or other connection fittings are required. A single spring, which partially overlays one axle member of each side shell, provides the necessary bias to maintain the side shells in a common horizontal plane in relation to the sponge support member. The side shells in this base plate assembly can then be rotated or pivoted in the conventional manner, in order to fold the sponge member of the mop and thus squeeze moisture from it. The assembly operates effectively and efficiently, requiring less component parts and less attendant manufacturing.

10 Claims, 3 Drawing Sheets

BUTTERFLY MOP BASE PLATE ASSEMBLY

BACKGROUND OF THE INVENTION

The butterfly sponge mop has been used with great success as an efficient cleaning tool for many years. The feature of the mop which allows its sponge to rotate or pivot closed, thereby squeezing fluid from a fully soaked or soiled sponge, has been a major advance in the industry. The butterfly sponge mop shown in U.S. Pat. No. 2,643,407 is representative of this type of mop.

There have been recent improvements to the butterfly sponge mop, most notably the use of a novel front scrubber on the mop, as seen in U.S. Pat. No. Re. 36,635, and the use of a molded center sponge support, as shown in U.S. Pat. No. Des. 420,775. However, the manner of connecting and pivoting the side shell pieces which actually rotate or pivot down onto the cleaning sponge member of these mops has remained substantially unchanged over the years. The mops disclosed in the referenced patents, as well as other prior butterfly mops which use side shells, routinely employ some type of intermediate attachment member, usually a rigid connection piece, which is secured to the underside of the sponge support member. The side shells are mounted on this connection piece, which allows the side shells to rotate or pivot down onto the mop's sponge member by the squeeze arms which are used on such mops. Two springs, one for each side shell, are normally used to bias the side shells in position in relation to the center sponge support member. This system, although commonly used, requires excess hardware and components and additional manufacturing process, all with attendant expense.

SUMMARY OF THE INVENTION

It is thus an object of the present invention to overcome the limitations and disadvantages of prior butterfly sponge mops and mop operation.

It is an object of the present invention to provide a butterfly sponge mop which has fewer components than existing mops for ease of manufacture, assembly and use.

It is a further object of the present invention to provide a butterfly sponge mop which simply, easily and, effectively provides for the biased pivoting of its side shell pieces over its cleaning sponge member.

It is still another object of the present invention to provide a butterfly sponge mop which allows for the direct connection without additional components, of its side shell pieces to the center sponge support member of the mop.

It is an additional object of the present invention to provide a butterfly sponge mop which uses integrally connected axle members to support and allow for the rotation or pivoting of shell pieces in relation to the center sponge support member of the mop.

It is a further object of the present invention to provide a butterfly sponge mop which uses a single spring to bias both side shell pieces in relation to the center sponge support member of the mop.

The present invention constitutes an improvement to the base plate assembly and the manner of operation of butterfly sponge mops. It consists of two side shell pieces, each with two outwardly extending axle members. The axle members are directly connected to the front and rear walls of the center sponge member support of the mop. No additional hardware or other connection means is required. A single spring, which partially overlays one axle member of each side shell, provides the necessary bias to maintain the side shells in a common horizontal plane in relation to the sponge support member. The side shells in this base plate assembly can then be rotated or pivoted in the conventional manner, in order to fold the sponge member of the mop and thus squeeze moisture from it. The assembly operates effectively and efficiently, requiring less component parts and less attendant manufacturing.

The novel features which are considered as characteristic of the invention are set forth in particular in the appended claims. The butterfly sponge mop base plate assembly itself, however, both as to its design, construction, and use, together with additional features and advantages thereof, are best understood upon review of the following detailed description with reference to the accompanying drawings.

DETAILED DESCRIPTION OF THE DRAWINGS

Figure 1:
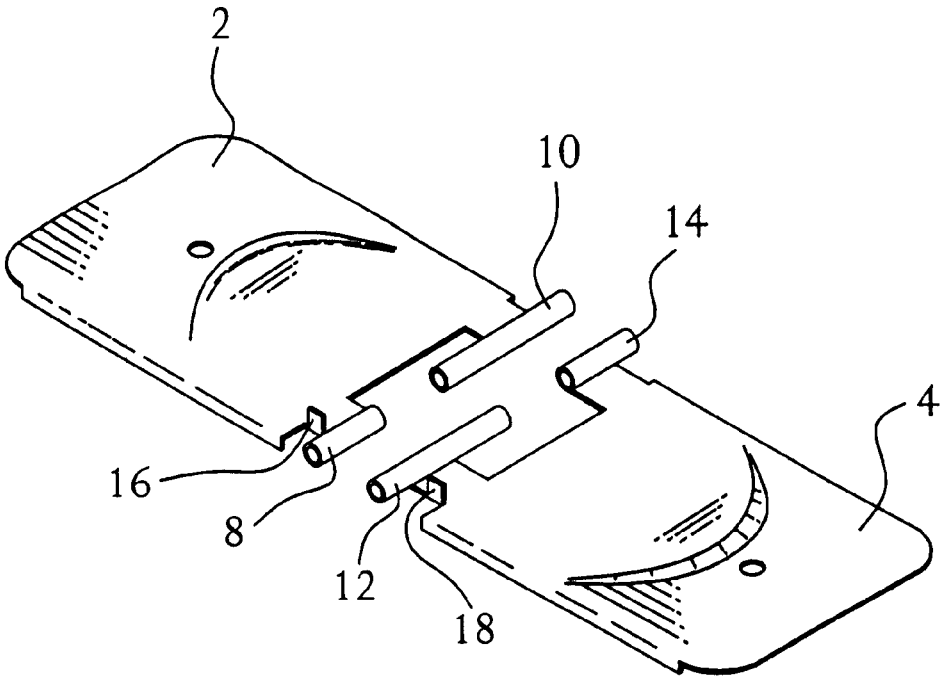
FIG. 1 is a view of both side shell pieces of the present invention.
Figure 2:
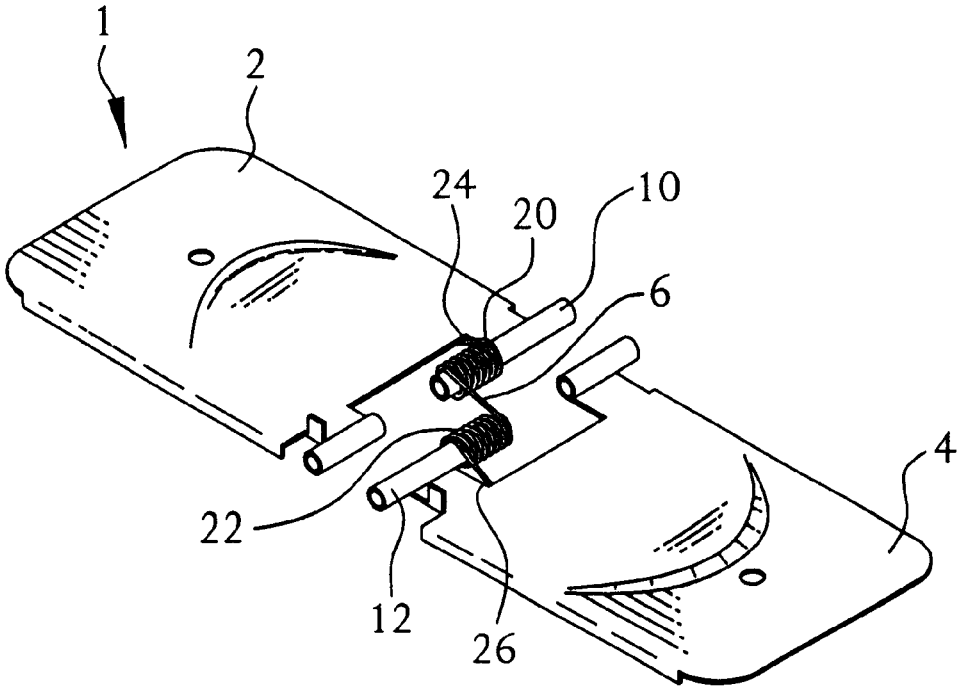
FIG. 2 is a view of the base plate assembly of the present invention, with its component parts assembled.

Base plate assembly 1 of the present invention, as shown in FIGS. 1 and 2, comprises three basic components, side shells 2 and 4 and spring member 6.

Side shell 2 comprises axle members 8 and 10, which are formed as integral parts of or can be permanently connected to the side shell. Similarly, side shell 4 comprises axle members 12 and 14. Side shells 2 and 4 also include thrust bearings 16 and 18, respectively. Thrust bearings 16 and 18 help to prevent axial movement of the base plate assembly when in use on the butterfly sponge mop.

Spring 6 comprises two sections 20 and 22. Section 20 partially overlays axle member 10 and section 22 partially overlays axle member 12. Spring 6 has end 24 extending under side shell 2 and end 26 extending under side shell 4.

Figure 3:
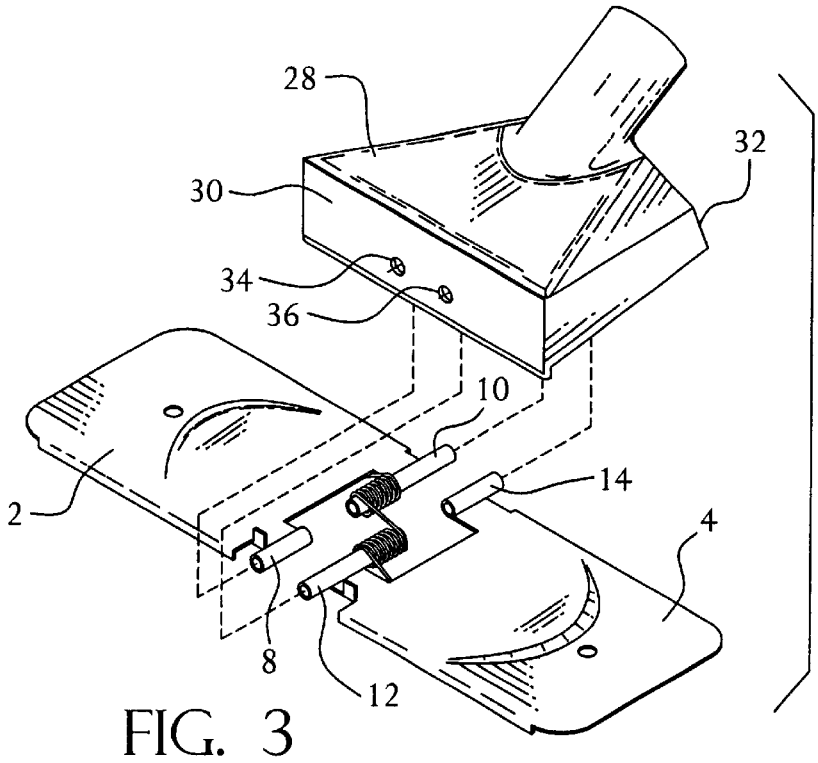
FIG. 3 shows the relationship of the placement of center sponge support member to the base assembly of the present invention.
Figure 4:
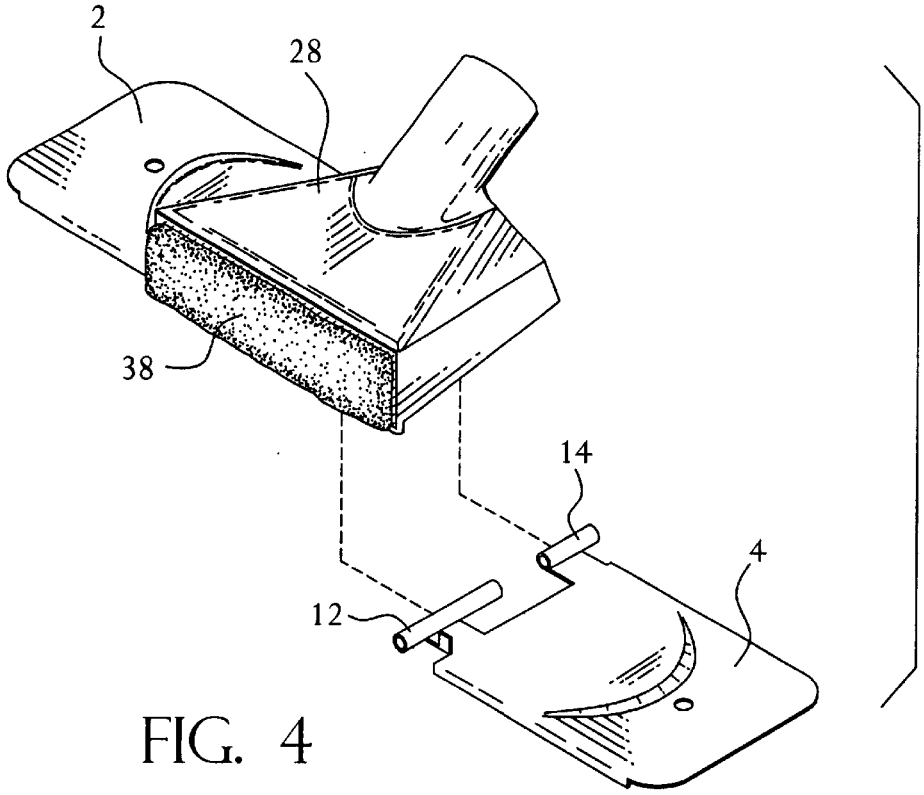
FIG. 4 shows the proper placement of the side shells in relation to the center sponge support member.

Base plate assembly 1, as shown in FIG. 2, is aligned with center sponge support member 28 of a butterfly sponge mop. Support member 28 comprises front outer wall 30 and rear outer wall 32. Front wall 30 has openings 34 and 36 therethrough, as shown in FIG. 3. It can be appreciated that similar openings are located through rear wall 32.

As seen in FIG. 3, axle members 8 and 12 are inserted into openings 34 and 36 of front wall 30 and axle members 10 and 14 are inserted into corresponding openings through rear wall 32. Axle members 8, 10, 12, and 14 are then permanently connected within openings 34 and 36 and the openings in rear wall 32. Abrasive cleaning element 38, more particularly shown and described in U.S. Pat. No. Re. 36,635 and U.S. Pat. No. Des. 420,775, can then be secured over front wall 30.

In this manner, side shells 2 and 4 are totally and directly supported by sponge support member 28. It can be appreciated that the positioning of spring 6 around axle members

10 and 12 and the placement of spring ends 24 and 26 underneath side shells 2 and 4, compels the side shells to be biased outward and remain in a common horizontal plane. When side shells 2 and 4 are rotated downward in a fashion well known in the art, such as by use of squeeze arms, as described in the U.S. patents referenced herein, they fold sponge member 40 in half, thus squeezing moisture from the sponge member.

Figure 5:
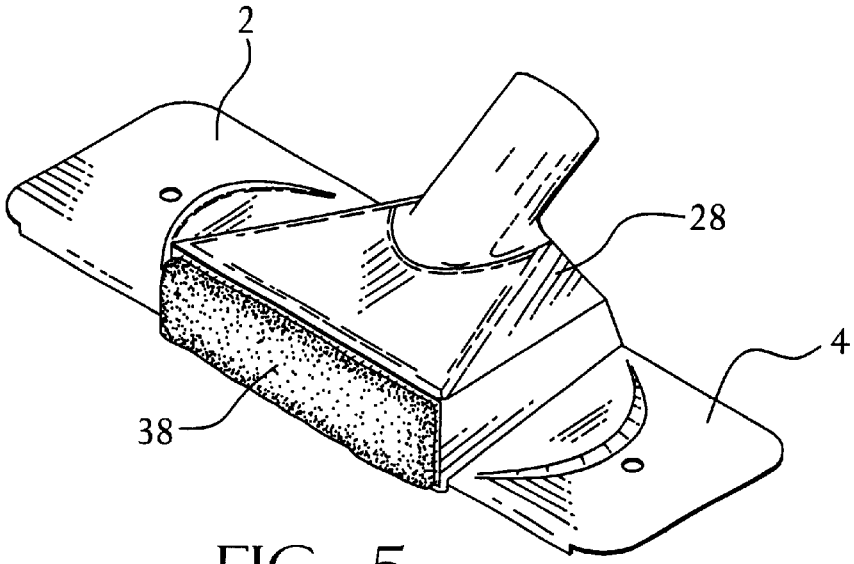
FIG. 5 shows the complete base assembly of the present invention installed onto the center sponge support member.
Figure 6:
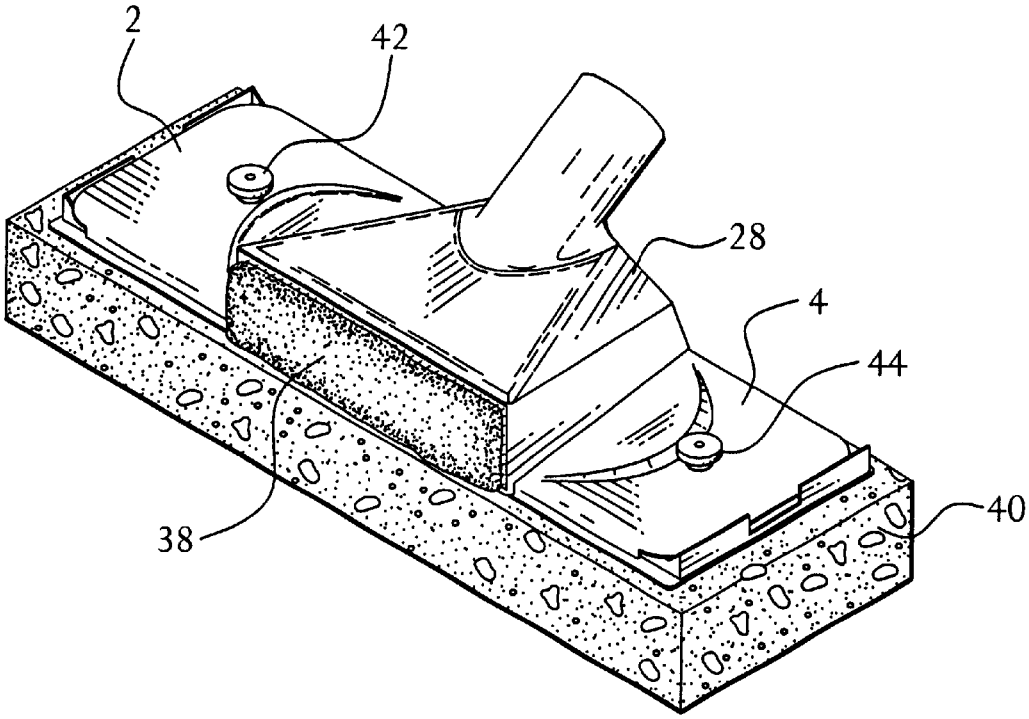
FIG. 6 shows a cleaning sponge member connected to the center sponge support member and base assembly of the present invention installed onto the sponge support member.

FIG. 5 shows the base plate assembly connected to support member 28 with abrasive member 38 attached. FIG. 6 shows the components assembled as per FIG. 5, except with sponge member 40 secured to side shells 2 and 4 by means of commonly used bolts connectors 42 and 44.

Certain novel features and components of this invention are disclosed in detail in order to make the invention clear in at lest one form thereof. However, it is to be clearly understood that the invention as disclosed is not necessarily limited to the exact form and details as disclosed, since it is apparent that various modifications and changes may be made without departing from the spirit of the invention.

What is claimed is:

1. A base plate assembly for a butterfly sponge mop comprising a sponge support member with outer walls and a sponge, said base plate assembly comprising:

(a) dual side shells connected to the sponge, each side shell comprising axle means which are directly attached to and rotatably supported solely by the sponge support member, said side shells being rotatable about the axle means to provide squeezing pressure to the sponge; and (b) a single spring means for biasedly maintaining the dual side shells in a common horizontal plane, said spring means comprising two sections, one section partially overlaying the axle means of one of the side shells and the other section partially overlaying the axle means of the second side shell.

2. The base plate assembly as in claim 1 wherein the axle means have ends which are inserted into the outer walls of the sponge support member, whereby the ends provide the direct attachment to the sponge support member and the rotatable support between the side shells and the sponge support member.

3. The base plate assembly as in claim 2 wherein the ends are secured within the outer walls of the sponge support member to allow rotatable movement of the side shells and axle means.

4. The base plate assembly as in claim 1 wherein the axle means on each side shell comprises two members.

5. The base plate assembly as in claim 4 wherein the spring means partially overlays one axle means member of each side shell.

6. The base plate assembly as in claim 5 wherein the axle means have ends which are inserted into the outer walls of the sponge support member.

7. The base plate assembly as in claim 1 further comprising thrust bearing means to limit axial movement of the side shells.

8. A base plate assembly for a butterfly sponge mop comprising a sponge support member and a sponge, said base plate assembly comprising:

(a) dual side shells connected to the sponge, each side shell comprising two axle members, the axle members being insertable into the sponge support member, such that the side shells and their respective axle members are rotatably supported by the sponge support member; and (b) a single spring means for biasing the side shells in position in relation to the sponge support member, said spring means comprising two sections, one section partially overlaying one axle member of a side shell and the other section partially overlaying one axle of the other side shell.

9. The base plate assembly as in 8 wherein the axle members are secured within outer walls of the sponge support member to allow rotatable movement of the side shells and axle member.

10. The base plate assembly as in claim 8 further comprising thrust bearing means to limit the axial movement of the side shells.

* * * * *